United States Patent [19]

Morishita et al.

[11] Patent Number: 4,931,663

[45] Date of Patent: Jun. 5, 1990

[54] STARTER MOTOR

[75] Inventors: Akira Morishita; Kazuhiro Odawara, both of Himeji, Japan

[73] Assignee: Mitsubishi Denki Kabushiki Kaisha, Tokyo, Japan

[21] Appl. No.: 310,573

[22] Filed: Feb. 15, 1989

[30] Foreign Application Priority Data

Feb. 26, 1988 [JP] Japan ..... 63-25278

[51] Int. Cl.[5] ..... F02N 11/00

[52] U.S. Cl. ..... 290/48; 74/7 A

[58] Field of Search ..... 290/98; 74/7 R, 7 A, 74/7 B, 7 C

[56] References Cited

U.S. PATENT DOCUMENTS 4,829,195 5/1989 Takami ..... 290/48

4,860,604 8/1989 Kinoshita ..... 74/7 C X 4,868,407 9/1989 Isozumi et al. ..... 290/48

*Primary Examiner*—Philip H. Leung

*Assistant Examiner*—W. E. Duncanson, Jr.

*Attorney, Agent, or Firm*—Sughrue, Mion, Zinn, Macpeak and Seas

[57] ABSTRACT

A starter motor which comprises a housing, an electric motor having an output rotary shaft, a pinion shift cylinder driven by the output rotary shaft and having a pinion for driving an engine to be started, the pinion shift cylinder having a sliding support surface exposed to the interior of the housing. The housing supports a support bearing which has a slinding surface in engagement with the sliding support surface of the pinion shift cylinder for slidably and rotatably supporting it. The starter motor also comprises a cylindrical cover for lovering the sliding support surface of the pinion shift cylinder against any foreign matter.

7 Claims, 3 Drawing Sheets

STARTER MOTOR

BACKGROUND OF THE INVENTION

This invention relates to a starter motor and more particularly to a starter motor having a pinion shift cylinder on which a pinion gear for engaging and driving an engine ring gear is provided and which is axially slidably supported on an output rotary shaft of the motor.

FIG. 1 illustrates one example of the conventional engine starter motor disclosed in Japanese Utility Model Laid-Open No. 61-6679.

In FIG. 1, the starter motor comprises a d.c. motor 1 for generating a rotational power for starting the engine and having an armature rotary shaft 2*a*, an output rotary shaft 2*b* integrally extended from the armature rotary shaft 2*a* of the d.c. motor 1, an over-running clutch 3 having a clutch inner member 3*a* and a clutch outer member 3*b* axially slidably fitted over the output rotary shaft 2*b*, a pinion 4 for engaging and driving an unillustrated ring gear of the engine, a pinion shift cylinder 5 for supporting the pinion 4 at its front end and connected at the rear end to the clutch inner member 3*a* of the over-running clutch 3, the pinion shift cylinder 5 being slidably fitted over the output rotary shaft 2*b*, and a housing 6 containing therein various components.

The pinion shift cylinder 5 is a hollow tubular member placed over the output rotary shaft of the d.c. motor 1 and rotatably and axially slidably supported by a bearing 7 fitted at its inner circumferential surface over the outer cylindrical surface 5*a* of the cylindrical body of the pinion shift cylinder 5. The outer cylindrical surface 5*a* of the pinion shift cylinder 5 is axially slidable relative to the inner surface of the bearing 7. In this context, the outer cylindrical surface 5*a* is a sliding support surface.

The starter motor also comprises a solenoid switch 8 having a plunger rod 8*a* and a shift lever 9. The shift lever 9 is connected at one end to the plunger row 8*a* and connected at the other end to the clutch outer member 3*b* of the over-running clutch 3. In order to rotatably support the pinion shift cylinder 5 on the output rotary shaft 2*b*, a bearing 10 is disposed between them and a stopper 11 is disposed at a position close to the front end of the output rotary shaft 2*b*. An end cap 12 is secured to the front end of the pinion shift cylinder 5 to cover the front end of the output rotary shaft 2*b*.

When the over-running clutch 3 is moved forward (to the right as seen in FIG. 1) by the shift lever 9, the pinion shift cylinder 5 is also moved forward along the output rotary shaft 2*b*, so that the pinion 4 on the pinion shift cylinder 5 is pushed out from an opening 13 of the housing 6 to engage the unillustrated engine ring gear. Just before the pinion 4 engages the engine ring gear, the d.c. motor 1 is energized through the solenoid switch 8 which also moves the shift lever 9. The rotation of the output rotary shaft 2*b* which is an extension of the armature rotary shaft 2*a* of the d.c. motor 1 is transmitted to the pinion shift cylinder 5 through helical splines 14 formed on the output rotary shaft 2*b* and the clutch outer member 3*b* and the clutch inner member 3*a* which is an integral part of the pinion shift cylinder 5.

With the conventional engine starter motor of this kind, since the pinion shift cylinder 5 must be supported in the housing so that it is axially slidable as well as rotatable, the inner circumferential surface of the bearing 7 is in contact with the outer cylindrical support surface 5*a* so that they are relatively slidable. Therefore, if any foreign matter sticks on the sliding surface 5*a* and caught between the sliding surface 5*a* and the inner surface of the bearing 7, the pinion shift cylinder 5 is prevented from smoothly moving around and along the output rotary shaft 2*b*. However, since the cylindrical support sliding surface 5*a* of the pinion shift cylinder 5 is only covered by the bearing 7 and other portion of the surface 5*a* is exposed within the interior of the housing. Therefore, foreign matters such as dust or the particles of the brush material from the electrical brushes of the d.c. motor 1 can easily fly onto the sliding surface 5*a* and stick on it, resulting in a jerky or irregular motion of the pinion shift cylinder 5 which significantly degrades the reliability of the starter motor.

SUMMARY OF THE INVENTION

Accordingly, an object of the present invention is to provide a starter motor which is free from the above-discussed problem.

Another object of the present invention is to provide a starter motor in which no foreign matter sticks to the sliding support surface of the pinion shift cylinder.

Still another object of the present invention is to provide a starter motor in which the sliding support surface of the pinion shift cylinder is covered.

With the above objects in view, the present invention resides in a starter motor which comprises a housing, an electric motor having an output rotary shaft, a pinion shift cylinder driven by the output rotary shaft and having a pinion for driving an engine to be started, the pinion shift cylinder having a sliding support surface exposed to the interior of the housing. The housing supports a support bearing which has a slinding surface in engagement with the sliding support surface of the pinion shift cylinder for slidably and rotatably supporting it. The starter motor also comprises a cylindrical cover for covering the sliding support surface of the pinion shift cylinder against any foreign matter.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
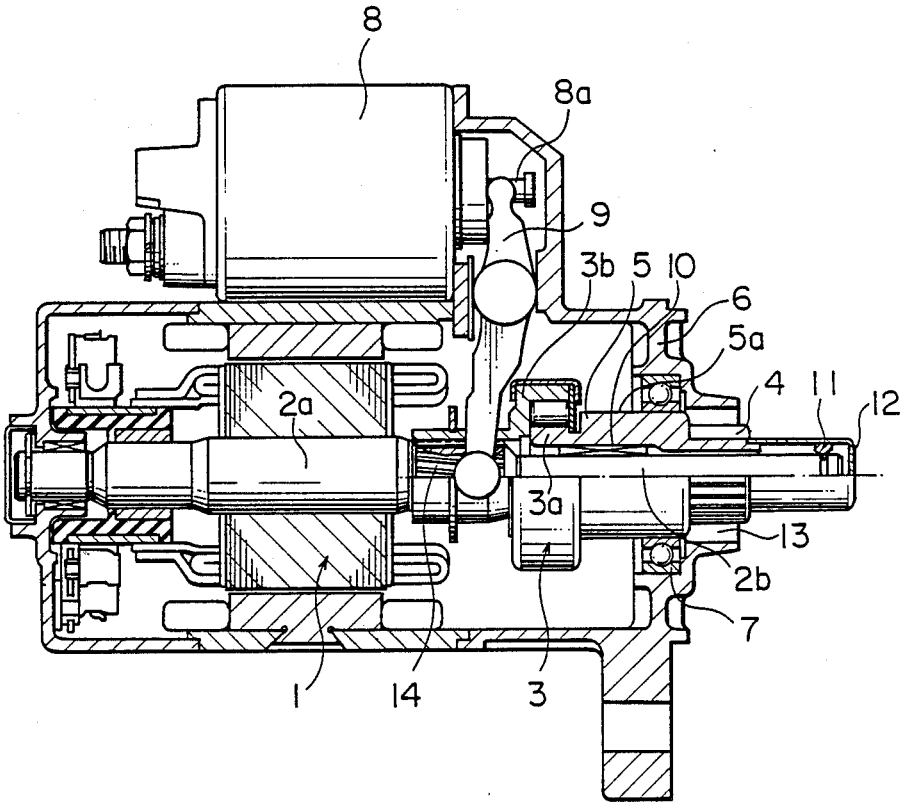
FIG. 1 PRIOR ART
FIG. 1 is a sectional view of a conventional starter motor.
Figure 2:
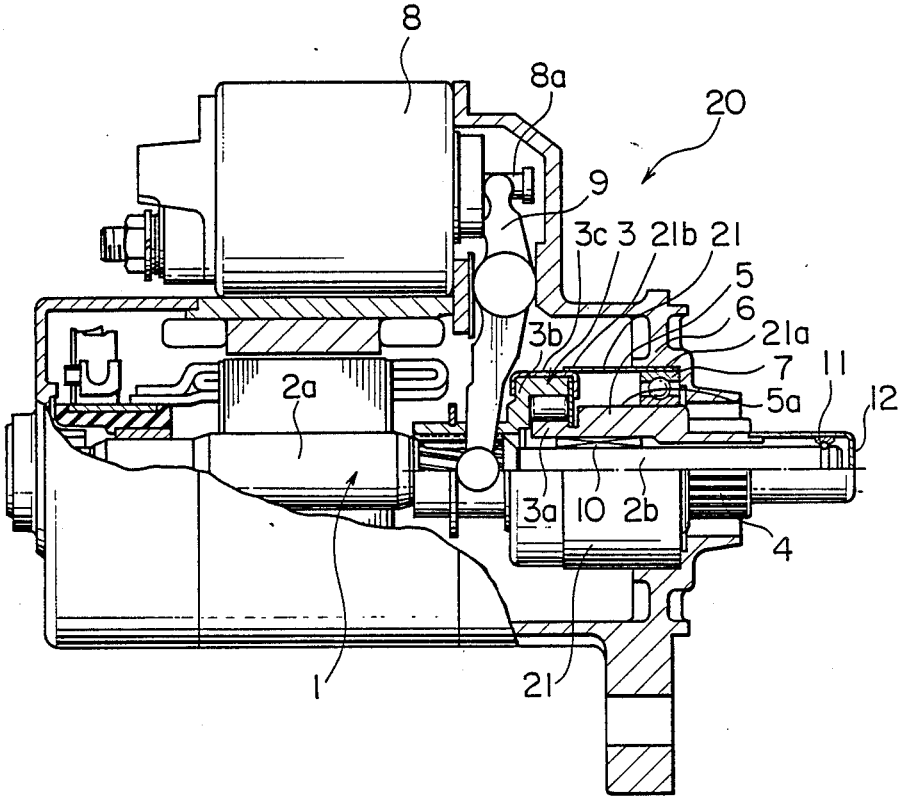
FIG. 2 is a sectional view of one embodiment of the engine starter motor of the present invention.

FIG. 2 illustrates one embodiment of the engine starter motor of the present invention. The starter motor comprises a d.c. motor 1 generating a rotational power for starting the engine. The motor has an armature rotary shaft 2*a* and an output rotary shaft 2*b* integrally extended from the armature rotary shaft 2*a* of the d.c. motor 1. An over-running clutch 3, which has a clutch inner member 3*a*, a clutch outer member 3*b* and a clutch cover 3*c*, is axially slidably fitted over the output rotary shaft 2*b*. A pinion 4 for engaging and driving an unillustrated ring gear of the engine to be started is also placed over the output rotary shaft 2*b* of the motor.

It is seen that a pinion shift cylinder 5 which is a generally hollow cylindrical member integrally supports the pinion 4 at its front end (right end as seen in FIG. 2) and is integrally connected at the rear end (left end as seen in FIG. 2) to the clutch inner member 3*a* of the over-running clutch 3. The pinion shift cylinder 5 is slidably fitted over the output rotary shaft 2*b* through a bearing 10 disposed between them. The pinion shift cylinder 5 is also and axially slidably supported by a bearing 7 such as a ball bearing supported by a housing 6.

The starter motor also comprises a solenoid switch 8 having a plunger rod 8*a*, a shift lever 9 connected at one end to the plunger rod 8*a* and connected at the other end to the clutch outer member 3*b* of the over-running clutch 3. A stopper 11 is disposed at a position close to the front end of the output rotary shaft 2*b*, and an end cap 12 is secured to the front end of the pinion shift cylinder 5 to cover the front end of the output rotary shaft 2*b*.

The pinion shift cylinder 5 is a hollow tubular member placed over the output rotary shaft of the d.c. motor 1 and rotatably and axially slidably supported by a bearing 7 fitted at its inner circumferential surface over the outer cylindrical surface 5*a* of the cylindrical body of the pinion shift cylinder 5. The outer cylindrical 5*a* of the pinion shift cylinder 5 is axially slidable relative to the inner surface of the bearing 7. In this context, the outer cylindrical surface 5*a* is a sliding support surface and the bearing 7 is mounting means for slidably and rotatably mounting the pinion shift cylinder 5.

According to the present invention, the starter motor further comprises a cover 21 for covering the cylindrical sliding support surface 5*a* of the pinion shift cylinder 5 exposed to the interior of the housing 6. The cover 21 is a hollow, generally cylindrical sheet member secured at one end 21*a* to the housing 6 to extend therefrom to surrond the exposed sliding support surface 5*a* at the other end 21*b*. In the illustrated embodiment, the first end 21*a* of the cover 21 is sandwiched and secured between the housing 6 and the outer circumference of an outer race of the bearing 7. It is also seen that the outer diameter of the over-running clutch 3 is substantially equal to that of the ball bearing 7 and therefore, the substantially cylindrical cover member 21 extends around the sliding support surface 5*a* and the second end 21*b* of the cover 21 is in sliding contact with the outer circumference of the over-running clutch 3.

Since the cylindrical support sliding surface 5*a* of the pinion shift cylinder 5 exposed to the interior of the housing 6 is covered by the cover 21, any foreign matters such as dust or the particles of the brush material from the electrical brushes of the d.c. motor 1 cannot come in contact with the sliding surface 5*a* and stick on it. Therefore, a smooth and reliable motion of the pinion shift cylinder 5 is ensured.

Figure 3:
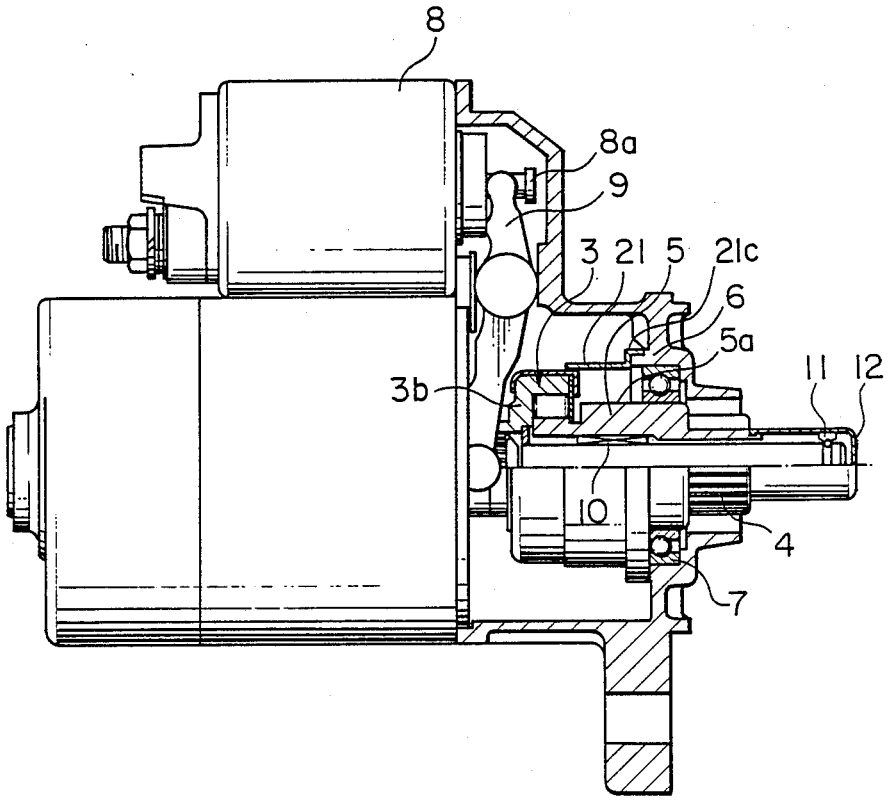
FIG. 3 is a sectional view of another embodiment of the engine starter motor of the present invention.

FIG. 3 illustrates another embodiment of the present invention in which a secured end 21*c* of the cover 21 is slightly modified to have radially outwardly extending flange portion and a large-diameter cylindrical portion extending from the outer periphery of the flange portion so that the secured end 21*c* of the cover 21 is located radially outwardly of the outer periphery of the outer race of the bearing 7. Therefore, the secured end 21*c* of the cover 21 of this embodiment is secured solely to the housing 6 and not inserted between the housing 6 and the bearing 7. In the embodiment shown in FIG. 3, the cover 21 is press fit onto the flange portion of the housing 6.

If it is desired, cover 21 may be replaced with an integral shield member integrally extending from the inner surface of the housing 6.

As has been described, since the starter motor of the present invention comprises a cylindrical cover for covering the sliding support surface of the pinion shift cylinder against any foreign matter, ingress of any foreign matter is prevented and no forming matter sticks to the sliding support surface of the pinion shift cylinder, making the operation of the starter motor smooth, long-lasting and reliable.

What is claimed is:

1. A starter motor comprising:

A housing;

an electric motor having an output rotary shaft;

a pinion shift cylinder driven by said output rotary shaft and having a pinion for driving an engine to be started, said pinion shift cylinder having a sliding support surface exposed to the interior of said a housing;

support means supported by said housing and having a sliding surface in engagement with said sliding support surface of said pinion shift cylinder for slidably and rotatably supporting it; and cover means for covering said sliding support surface of said pinion shift cylinder.

2. A starter motor comprising:

an electric motor having an output rotary shaft;

an over-running clutch axially slidably mounted on said output rotary shaft;

a solenoid switch for axially sliding said over-running clutch on said output rotary shaft;

a pinion shift cylinder having at one end thereof a pinion and connected at the other end to said over-running clutch, said pinion shift cylinder being in a slidable and rotatable engagement with said output rotary shaft;

mounting means for slidably and rotatably mounting said pinion shift cylinder to said housing;

said pinion shift cylinder having a cylindrical sliding support surface which is in engagement with said mounting means and slidably supported thereby; and cover means for covering said cylindrical sliding support surface of said pinion shift cylinder.

3. A starter motor as claimed in claim 1, wherein said cover means comprises a hollow sheet member surrounding said sliding support surface.

4. A stater motor as claimed in claim 3, wherein said hollow sheet member is secured to said housing.

5. A stater motor as claimed in claim 4, wherein said hollow sheet member is secured between said housing and said mounting means.

6. A stater motor as claimed in claim 2, wherein said mounting means comprises a ball bearing and said cover is a substantially cylindrical shield member.

7. A stater motor as claimed in claim 2, wherein said cover is a substantially cylindrical shield member extending around an outer circumference of said over-running clutch.

* * * * *